US006779697B2

(12) United States Patent
Lin

(10) Patent No.: US 6,779,697 B2
(45) Date of Patent: Aug. 24, 2004

(54) PNEUMATIC NAILER WITH ROTATABLE AND MOVABLE MAGAZINE

(76) Inventor: Wang-Kuan Lin, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 10/227,513

(22) Filed: Aug. 26, 2002

(65) Prior Publication Data

US 2004/0084501 A1 May 6, 2004

(51) Int. Cl.[7] ..... B25C 1/00

(52) U.S. Cl. ..... 227/120; 227/130; 227/148; 227/156

(58) Field of Search ..... 227/110, 119, 227/120, 130, 148, 156

(56) References Cited

U.S. PATENT DOCUMENTS 3,438,449 A * 4/1969 Smith ..... 173/17
3,708,096 A * 1/1973 Burke, Jr. ..... 227/130
3,820,705 A * 6/1974 Beals ..... 227/113
5,074,453 A * 12/1991 Tachihara et al. ..... 227/130
6,095,394 A * 8/2000 Wang-Kuan ..... 227/130

* cited by examiner

*Primary Examiner*—Scott A. Smith
*Assistant Examiner*—Paul Durand
(74) *Attorney, Agent, or Firm*—Charles E. Baxley

(57) ABSTRACT

A pneumatic nailer includes body for receiving the piston therein and a barrel is rotatably and movably inserted in a connection tube extending from the body. The piston rod is movably inserted in the barrel for ejecting the nail fed in the barrel. A magazine is connected to the barrel so that the magazine is rotatable relative to the body so that the magazine is rotated a new position and used in a space that the conventional magazine cannot be inserted.

3 Claims, 10 Drawing Sheets

PNEUMATIC NAILER WITH ROTATABLE AND MOVABLE MAGAZINE

FIELD OF THE INVENTION

The present invention relates to a pneumatic nailer that has a magazine for receiving nails therein and the magazine is rotatable and/or movable relative to the barrel so as to meet requirements for working in narrow space.

BACKGROUND OF THE INVENTION

A conventional pneumatic nailer is shown in FIG. 1 and generally includes a body 10 with a handle 101 for being connected to a hose from a compressor (both not shown), a barrel with a nose 11 connected to an end of the barrel, a safety device 13 which is incorporated with the nose and the trigger 12 a trigger 12, and a magazine 14 connected to the barrel and nails received in the magazine 14. The nails are ejected out from the nose 11 by pressing the safety device 13 and pulling the trigger 12. The body 10 and the handle 101 are made by cast iron so that the whole assembly is so heavy and difficult to hold it for a long period of time. The pneumatic power generates a huge vibration to the nailer and this could shift the nose 11 from the desired spot on the object to be nailed. The heavy body 10 could hit on the object after each shot because it is so heavy that the user cannot hold it in position. The magazine 14 is fixed to the barrel and cannot be adjusted its position relative to the body 10 such that the nailer could not be possible inserted in a narrow space because the magazine 14.

The present invention intends to provide a pneumatic nailer which has a rotatable magazine that is rotated about the axis of the body of the nailer so as to allow the nailer to be used in a space that the conventional nailer can not be used.

SUMMARY OF THE INVENTION

In accordance with one aspect of the present invention, there is provided a pneumatic nailer which comprises a body having a piston movably received in a chamber thereof and a piston rod extends from the piston and extends out from a connection tube of the body. A barrel has a first end rotatably and movably received in the connection tube and a spring is received in the connection tube so as to bias the first end of the barrel. The piston rod extends in a longitudinal passage in the barrel. A magazine is connected to the barrel and communicates with the longitudinal passage in the barrel.

The primary object of the present invention is to provide a pneumatic nailer that has a rotatable and movable barrel, and a magazine is connected to the barrel so that the magazine can be rotated to a desired position so a to be used in a narrow space.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
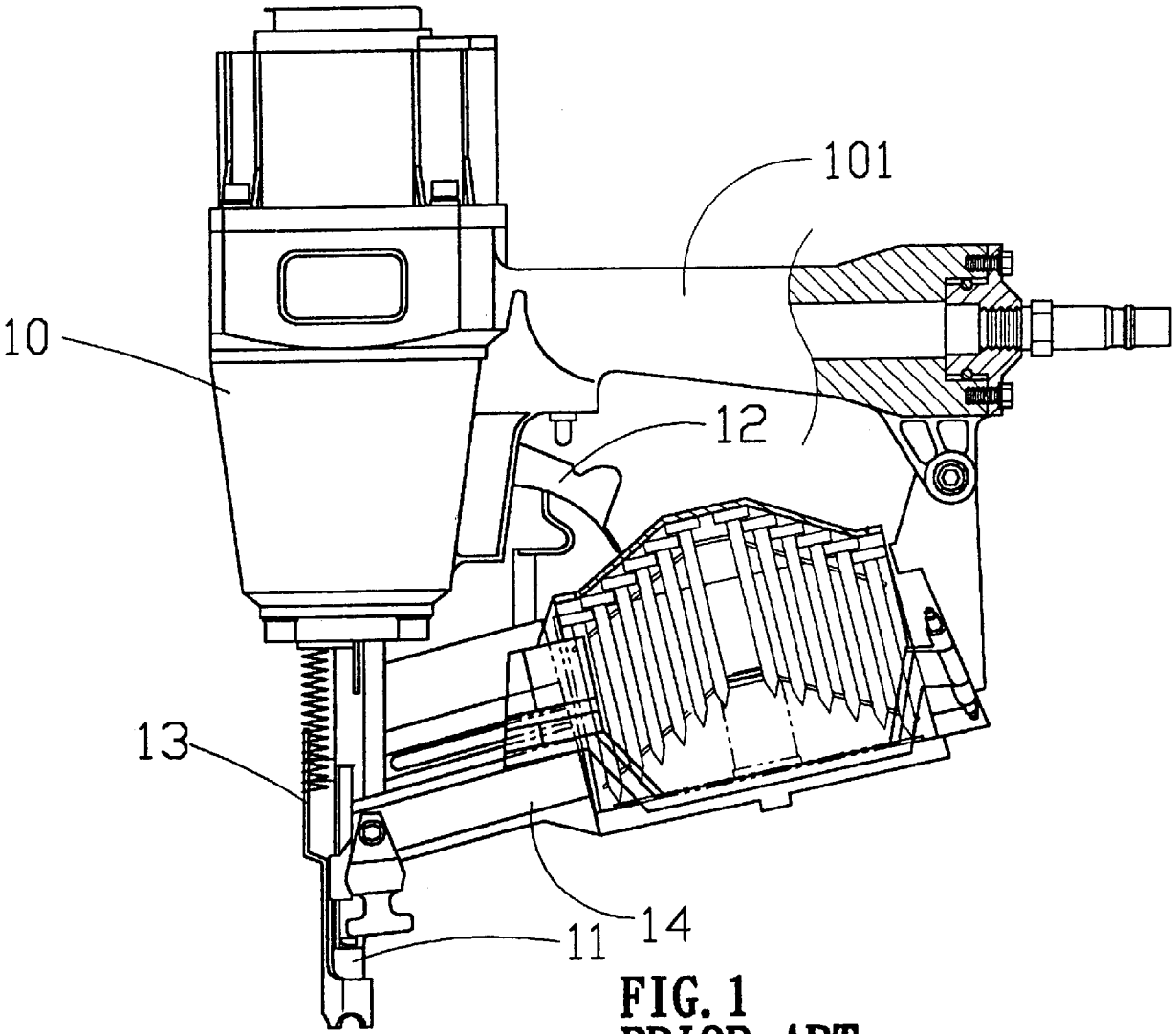
FIG. 1 PRIOR ART
FIG. 1 shows a conventional pneumatic nailer.
Figure 2:
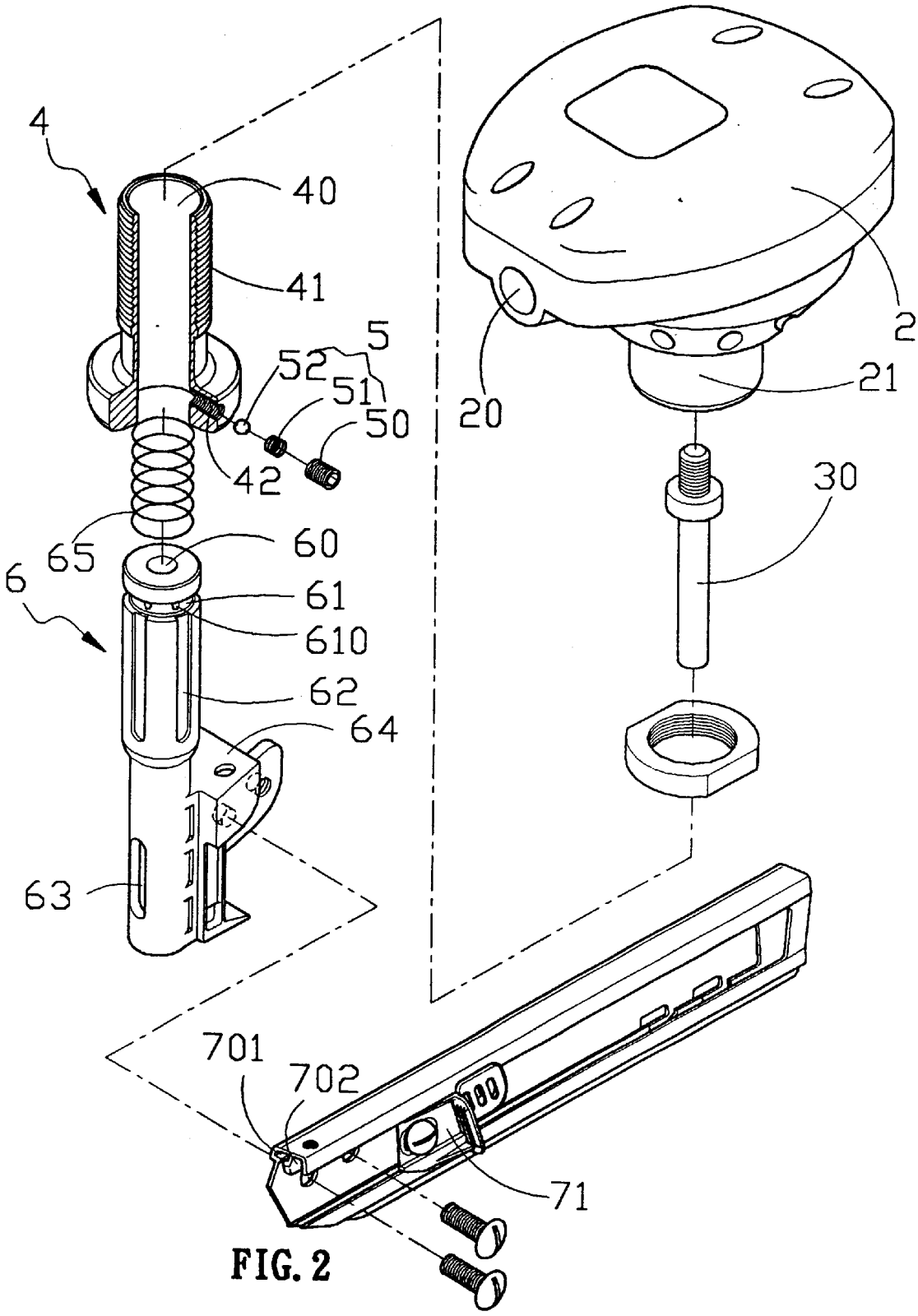
FIG. 2 is a perspective view to show the pneumatic nailer of the present invention.
Figure 3:
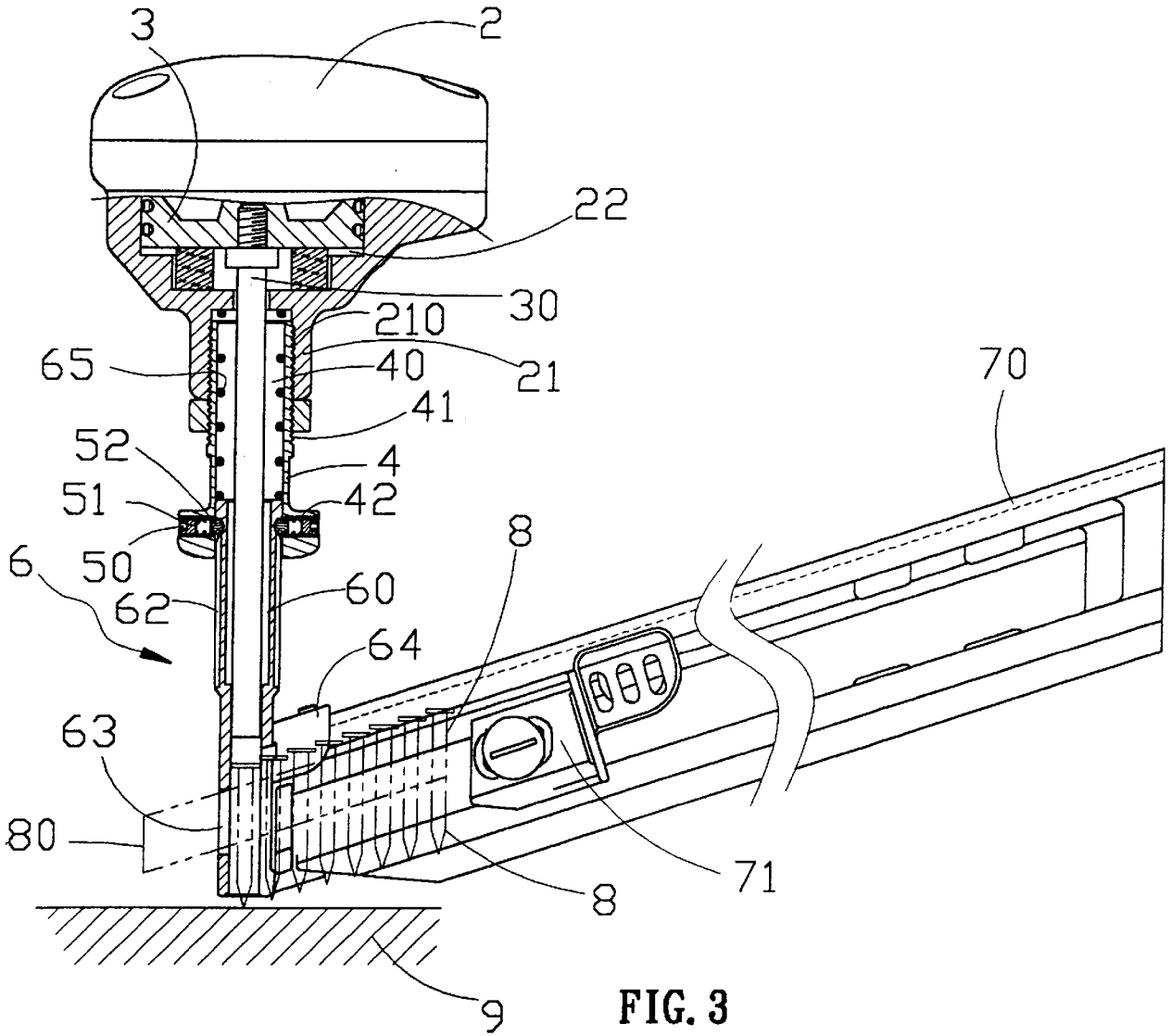
FIG. 3 is a side view to show the pneumatic nailer of the present invention is to be used to nail an object.

Referring to FIGS. 2 and 3, the pneumatic nailer of the present invention comprises a body 2 having a piston 3 movably received in a chamber 22 in the body 2 and a piston rod 30 extends from the piston 3 and extends out from a connection tube 21 of the body 2. An inlet 20 is defined in a side of the body 2 so as to be connected to a hose of a compressor (both not shown). A position sleeve 4 has a threaded outer periphery 41 which is threadedly connected to an inner threaded periphery 210 in the connection tube 21. The position sleeve 4 includes a flange and a hole 42 is radially defined therethrough so as to receive a biasing assembly 5 therein which includes a bead 52, a spring 51 and a bolt 50.

A barrel 6 has a first end rotatably and movably received in the position sleeve 4 and a spring 65 is received in the position sleeve 4 and biases the first end of the barrel 6. The piston rod 30 extends through the passage 40 of the position sleeve 4 and a longitudinal passage 60 in the barrel 6. A connection part is connected to a second end of the barrel 6 and has an engaging port 64 which is engaged with a magazine 70 in which nails 8 are received. The magazine 70 communicates with the longitudinal passage 60 in the barrel 6 and a slot 63 is defined through the wall of the connection part and located corresponding to the magazine 70 such that a plate 80 for connecting the nails 8 can extend therethrough. The magazine 70 has two grooves 701 and 702 for heads of the nails 8 and a pushing piece 71 movably engaged therein. The pushing piece 71 pushes the nails 8 toward the barrel 6 and the first one of the nails 8 is fed in the connection part and the tip of the nail 8 protrudes from the distal end of the connection part. The piston rod 30 is located above the head of the nail 8 in the connection part.

A groove 61 is defined in an outer periphery of the barrel 6 and located close to the first end of the barrel 6. A plurality of positioning dimples 610 are defined in an inner periphery of the groove 61 and the bead 52 is engaged with one of the dimples 610. A plurality of elongated recesses 62 are defined longitudinally in the outer periphery of the barrel 6 and communicate with the groove 61.

Figure 4:
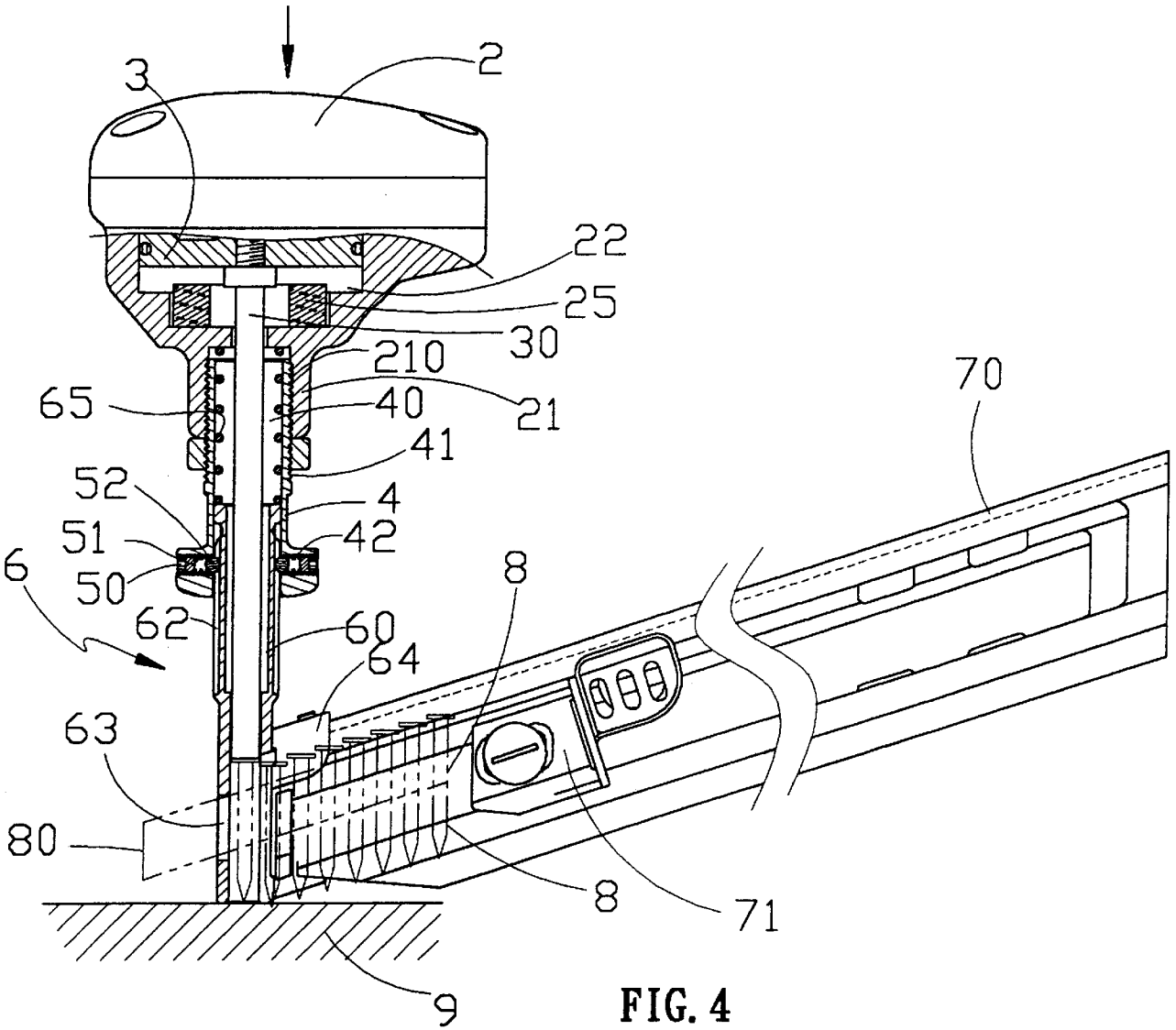
FIG. 4 is a side view to show the pneumatic nailer of the present invention is pushed toward the object.
Figure 5:
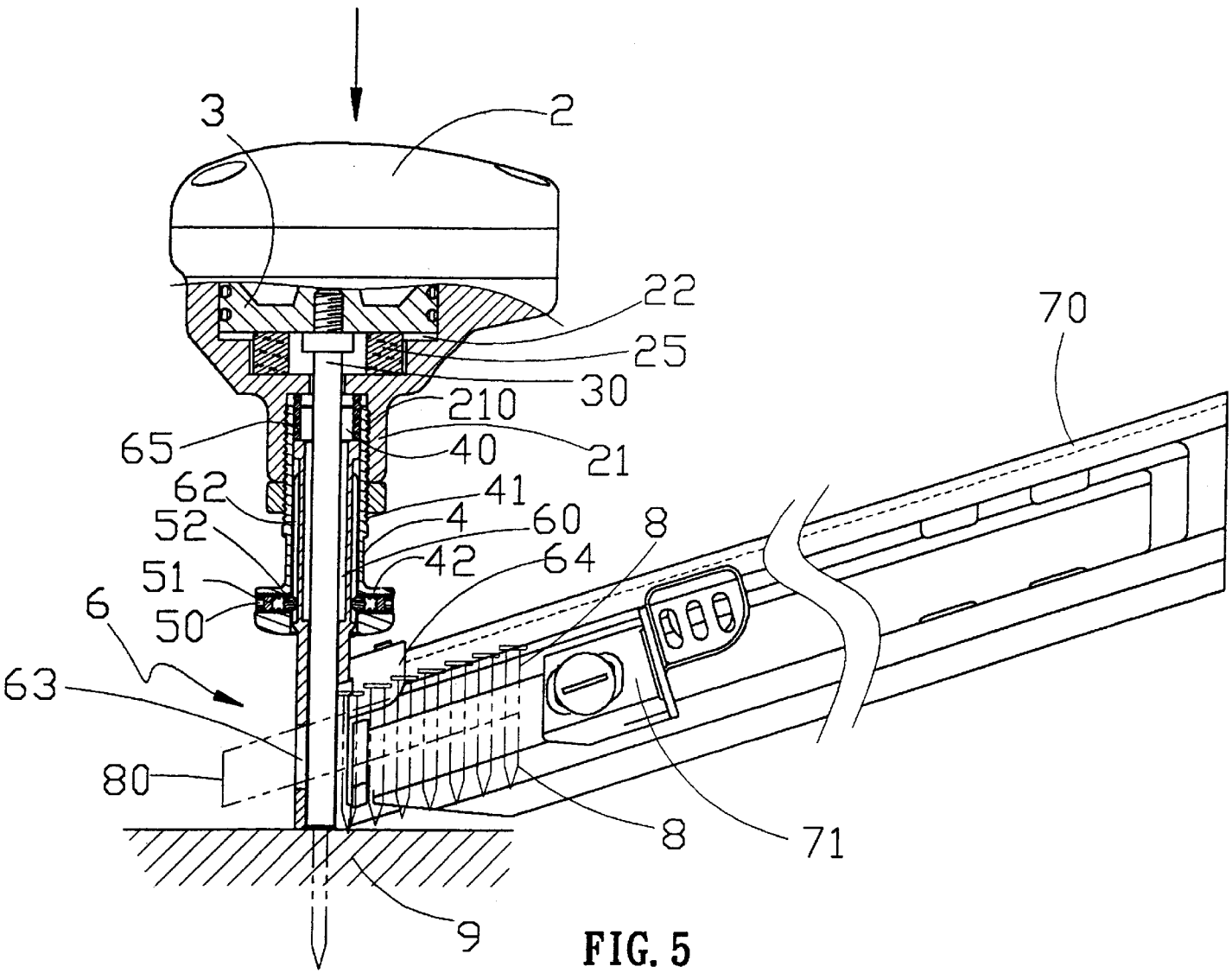
FIG. 5 is a side view to show the pneumatic nailer of the present invention is activated to send a nail into the object.

When pushing the body 2 to let the distal end of the connection part contact against the object 9 to be nailed as shown in FIG. 4, the tip of the nail 8 is pushed into the surface of the object 9 and the barrel 6 is moved upward to compress the spring 65. Then the piston 3 is pushed by pneumatic power to impact on the head of the nail 8 which penetrates into the object 9.

Figure 6:
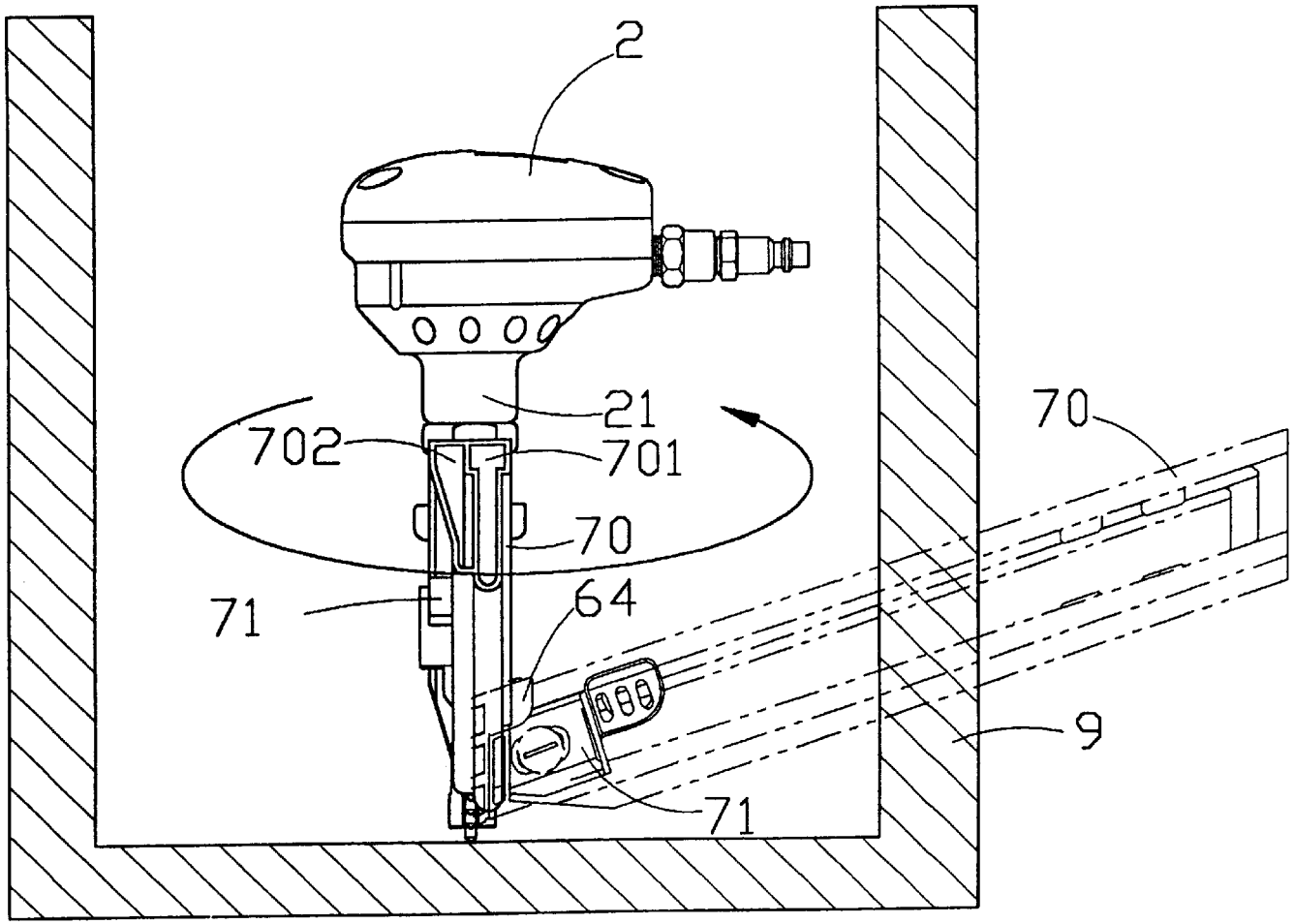
FIG. 6 shows that the magazine is rotatable relative to the body of the pneumatic nailer of the present invention.
Figure 7:
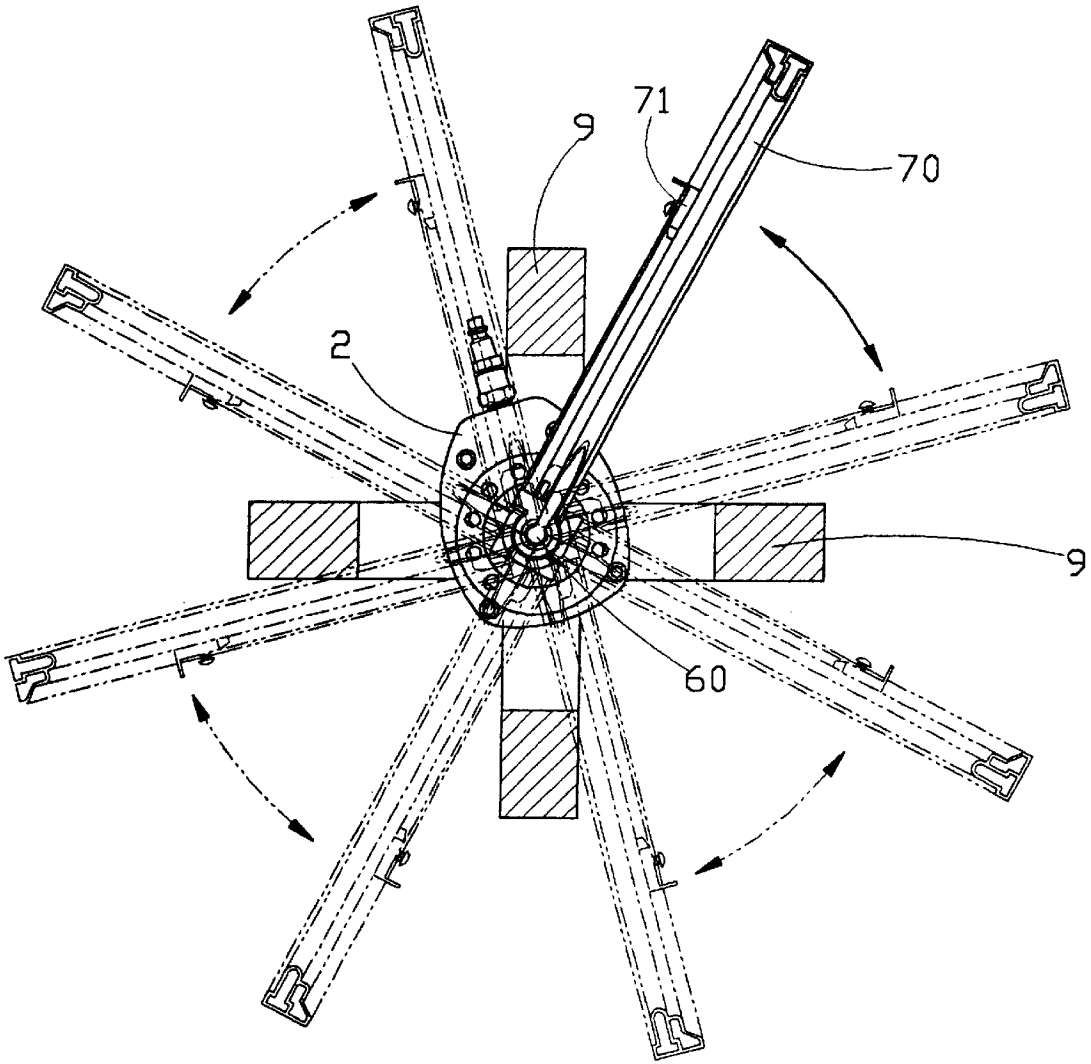
FIG. 7 shows that the magazine is rotated 360 degrees.

Referring to FIGS. 6 and 7, the magazine 70 can be rotated 360 degrees about the position sleeve 4 as needed so as to let the magazine 70 be positioned at desired angle such that the magazine 70 is not blocked by other items around the object 9.

Figure 8:
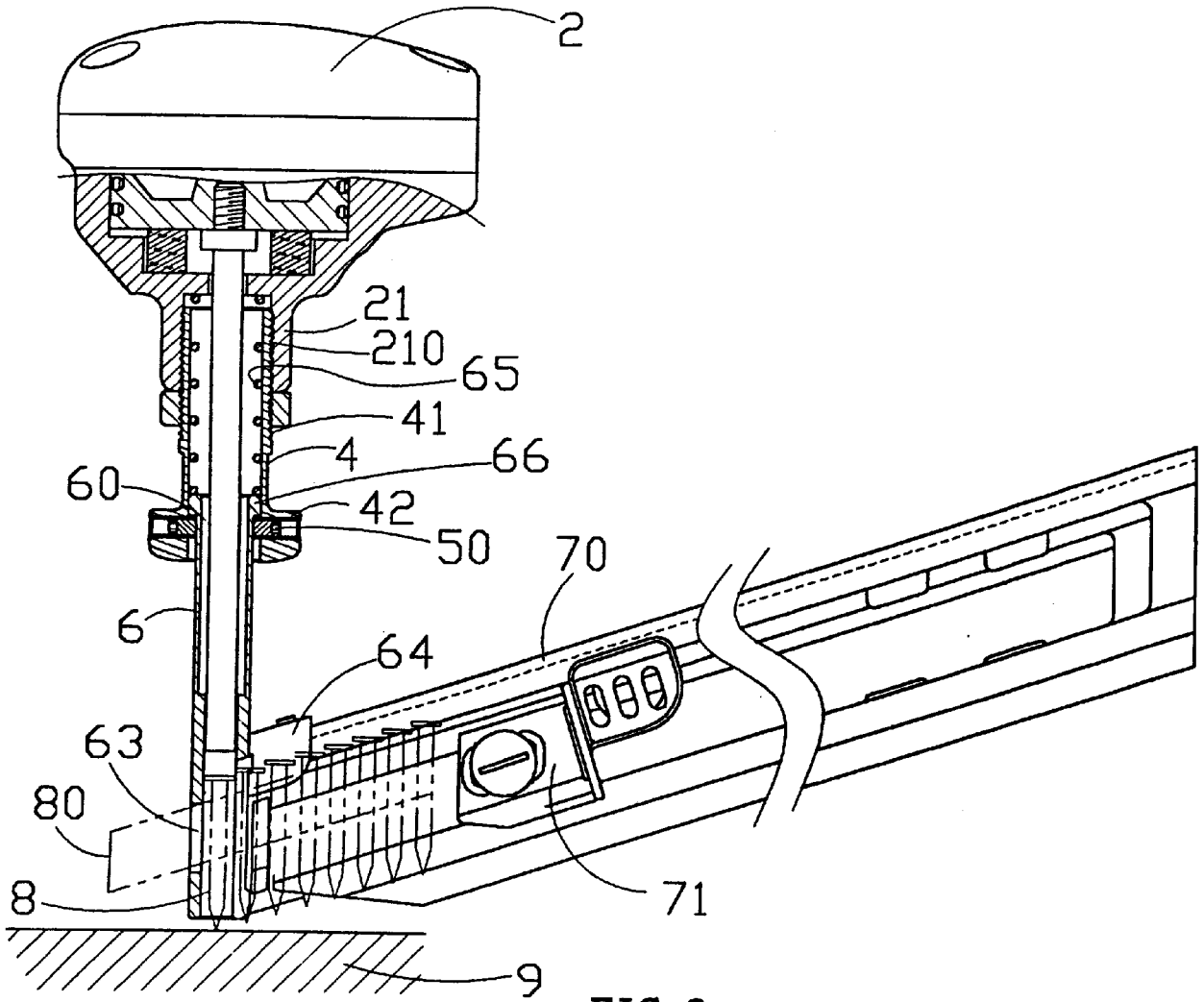
FIG. 8 shows that the barrel has an enlarged head.

FIG. 8 shows that the barrel 7 has an enlarged head 66 and the biasing assembly 5 urges the outer periphery of the barrel 6 such that the barrel 6 is rotatable.

Figure 9:
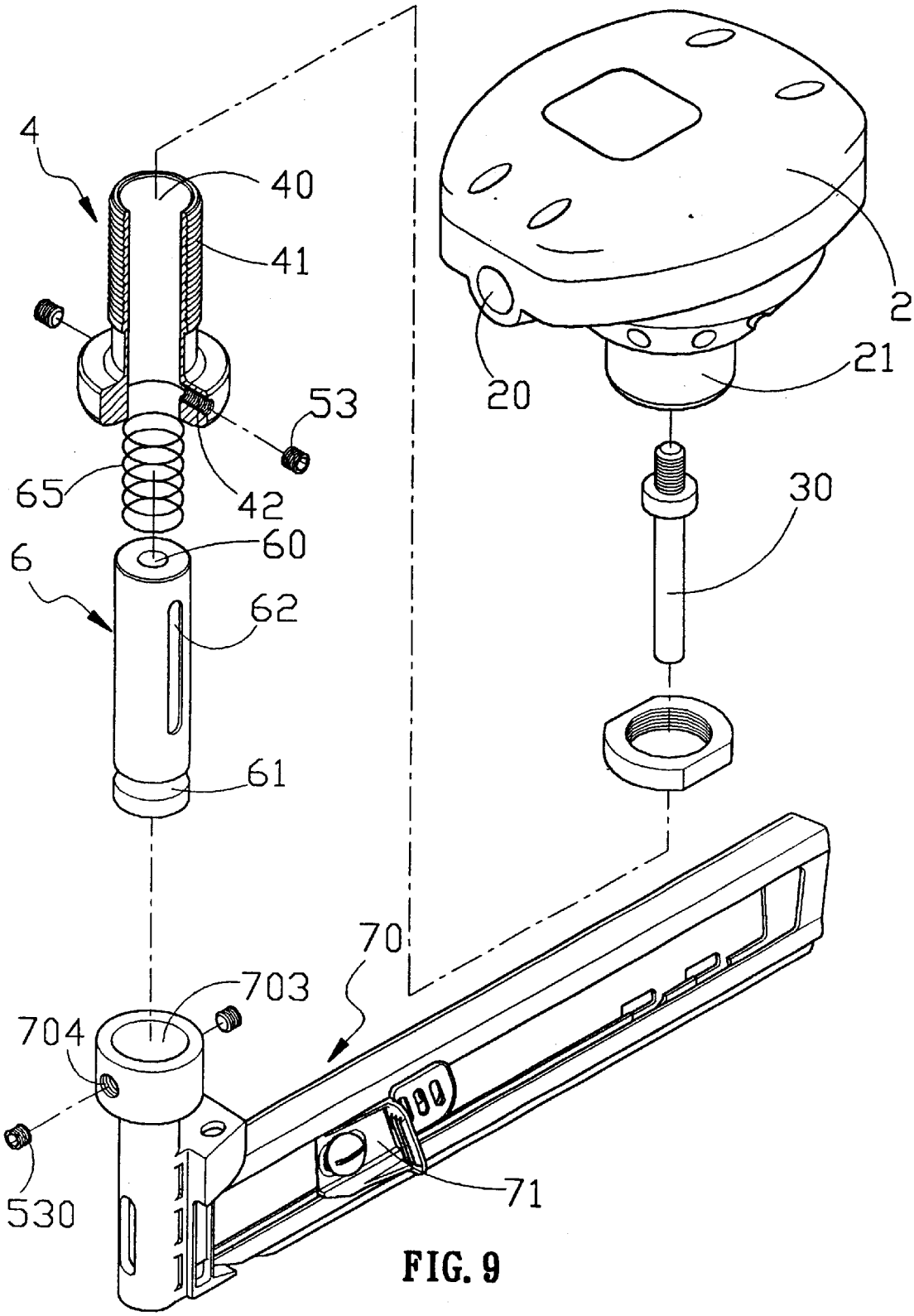
FIG. 9 is an exploded view to show another embodiment of the pneumatic nailer of the present invention.

FIG. 9 shows another embodiment of the pneumatic nailer wherein the barrel 6 has a first end movably received in the position sleeve 4 and a spring 65 is received in the connection tube 21 and biases the first end of the barrel 6. The position sleeve 4 has two holes 42 radially defined therethrough and two pieces 53 are received in the holes 42 respectively. Two elongated recesses 62 are defined longitudinally in an outer periphery of the barrel 6 and the pieces 53 are received in the elongated recess 62. A groove 61 is defined in an outer periphery of the barrel 6 and located close to the second end of the barrel 6. A connection part is fixed to the magazine 70 and two holes 704 are radially defined through the connection part. the magazine 70 communicates with the longitudinal passage 60 in the barrel 6. A passage 703 is defined in which the barrel 6 is rotatably received. Another piece 530 received in each of the holes 704 and engaged with the groove 61.

Figure 10:
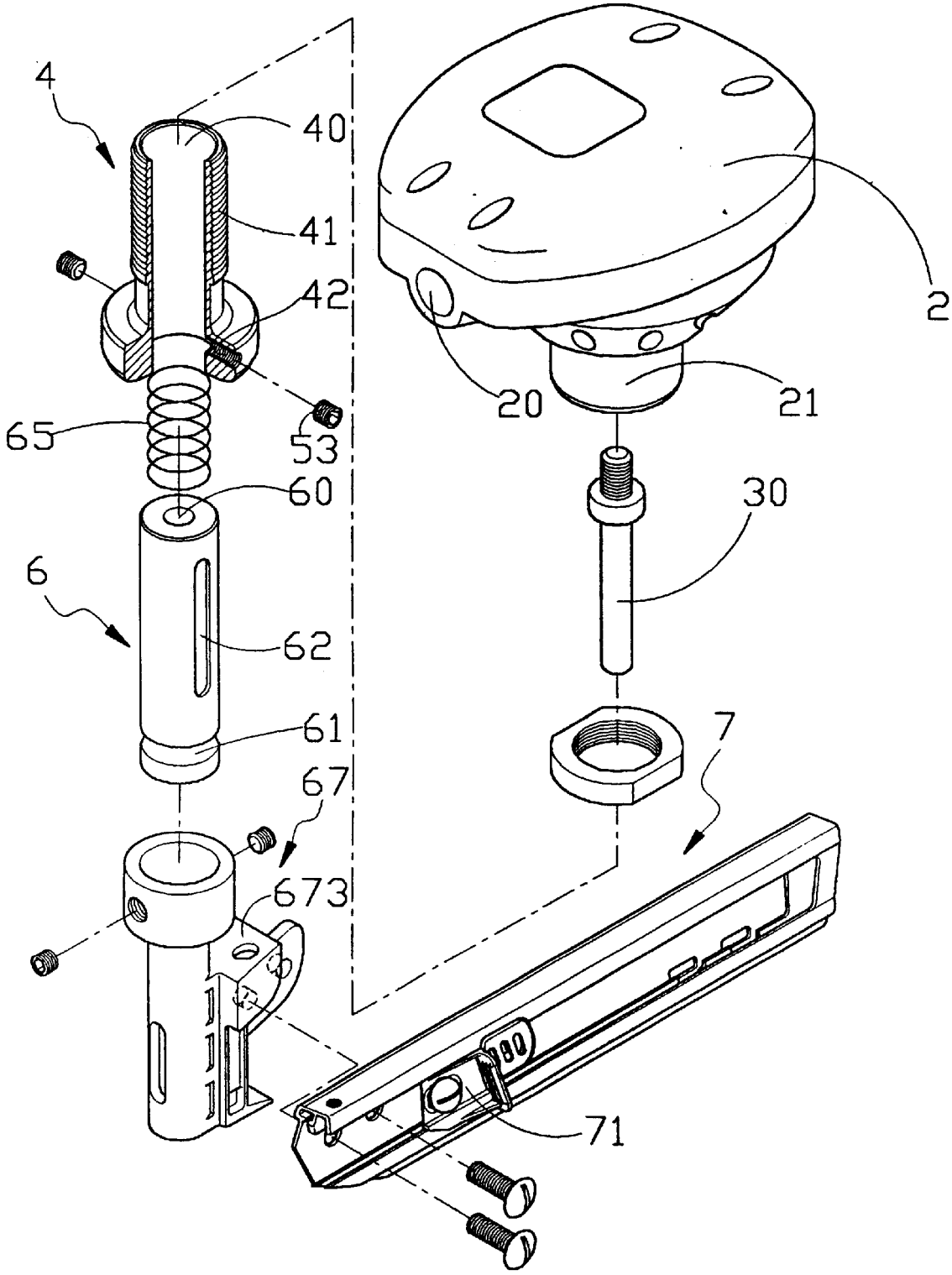
FIG. 10 is an exploded view to show yet another embodiment of the pneumatic nailer of the present invention.

FIG. 10 shows that the connection part 67 as shown in FIG. 9 is assembled to the magazine by a connection port 673 such that the connection part 67 is conveniently connected to the existed magazines 70.

While we have shown and described the embodiment in accordance with the present invention, it should be clear to those skilled in the art that further embodiments may be made without departing from the scope of the present invention.

What is claimed is:

1. A pneumatic nailer comprising:

a body having a piston movably received in a chamber in the body, a piston rod extending from the piston and extending out from a connection tube of the body, a position sleeve connected to the connection tube and a hole radially defined through position sleeve, a bead and a spring received in the hole;

a barrel having a first end rotatably and movably received in the position sleeve, a groove defined in an outer periphery of the barrel and the bead engaged with the groove, a plurality of elongated recesses defined longitudinally in the outer periphery of the barrel and communicating with the groove, a spring received in the position sleeve and biasing the first end of the barrel, the piston rod extending in a longitudinal passage in the barrel, and a magazine connected to the barrel and communicating with the longitudinal passage in the barrel.

2. The nailer as claimed in claim 1 further comprising a plurality of positioning dimples defined in an inner periphery of the groove and the bead engaged with one of the dimples.

3. A pneumatic nailer comprising:

a body having a piston movably received in a chamber in the body, a piston rod extending from the piston and extending out from a connection tube of the body, a position sleeve connected to the connection tube and a hole radially defined through position sleeve, a piece received in the hole;

a barrel having a first end movably received in the position sleeve and a spring received in the position sleeve and biasing the first end of the barrel, the piston rod extending in a longitudinal passage in the barrel, an elongated recess defined longitudinally in an outer periphery of the barrel and the piece received in the elongated recess, a groove defined in an outer periphery of the barrel and located close to a second end of the barrel, a magazine having a connection part and a passage defined in the connection part, the second end of the barrel rotatably received in the passage of the connection part, a hole radially defined through the connection part, another piece received in the hole of the connection part and engaged with the groove of the barrel, the magazine communicating with the longitudinal passage in the barrel.

* * * * *